US005554198A

United States Patent [19]

Poplin

[11] Patent Number: 5,554,198

[45] Date of Patent: Sep. 10, 1996

[54] METHOD FOR DYEING FABRIC

[75] Inventor: Mark K. Poplin, Miami, Fla.

[73] Assignee: Tinter Inc., Opa-Locka, Fla.

[21] Appl. No.: 372,974

[22] Filed: Jan. 17, 1995

[51] Int. Cl.[6] ..... D06P 5/12; D06P 5/22

[52] U.S. Cl. ..... 8/482; 8/483; 8/576; 8/606; 8/611; 8/552

[58] Field of Search ..... 8/478, 481, 482, 8/483, 484, 542, 576, 606, 611

[56] References Cited

U.S. PATENT DOCUMENTS

| | | | |
|---|---|---|---|
| 1,623,709 | 9/1923 | Smith | 8/482 |
| 2,296,379 | 9/1942 | Croft | 8/482 |
| 2,823,092 | 2/1958 | Spencer | 8/482 |
| 3,652,198 | 3/1972 | Farber et al. | 8/481 |
| 3,669,611 | 6/1972 | Shimauchi et al. | 8/481 |
| 3,975,151 | 8/1976 | Berg et al. . | |
| 4,297,099 | 10/1981 | Simon et al. . | |
| 4,881,941 | 11/1989 | Dixon . | |
| 5,019,131 | 5/1991 | Nitsch, Jr. . | |
| 5,082,468 | 1/1992 | Hopkins . | |
| 5,201,915 | 4/1993 | Ricci . | |

*Primary Examiner*—Margaret Einsmann
*Attorney, Agent, or Firm*—Amster, Rothstein & Ebenstein

[57] ABSTRACT

This invention provides a method for applying color to a fabric to create random dye patterns thereon. The method comprises the steps of applying at least one dye accelerant onto the fabric in a random and nonuniform manner so that the resulting fabric has random areas containing dye accelerant and random areas not containing dye accelerant; applying dye to the fabric at a temperature effective to permit rapid absorption of the dye into the dye accelerant containing areas, and less or no absorption of the dye into the areas not containing dye accelerant; and removing unabsorbed dye while inhibiting migration of absorbed dye within the fabric. The present invention also provides a method for applying color to a fabric utilizing an automated dyeing apparatus. The present invention further provides a vat-dyed fabric having differing random patterns of dye intensity of at least one color on opposite sides of the fabric.

23 Claims, 3 Drawing Sheets

METHOD FOR DYEING FABRIC

BACKGROUND OF THE INVENTION

The present invention is directed to a method for producing fabrics with simulated tie-dye appearance. The fabrics produced by the method resemble conventional tie-dyed fabrics but have less symmetrical patterns and different patterns on opposite sides of the fabric. Since the method may be fully automated, the method is more efficient, requires less operator skill and time, and is therefore less costly than traditional tie-dying methods.

Traditional tie-dying methods involve the steps of manually tying fabric either on itself or with rubber bands or string, applying dye, and untying the fabric or removing the rubber bands or string to create a pattern conventionally recognized as a tie-dyed pattern. The resulting dyed pattern is generally a symmetrical, flower-like pattern which is uniform on both sides of the fabric. Since conventional tie-dyeing must be done manually, and requires both operator skill and time to achieve the desired effect, the dyeing of tie-dye patterns is relatively more expensive than conventional automated dyeing.

Another method for obtaining the "tie-dyed" look is described in U.S. Pat. No. 3,975,151, issued Aug. 17, 1976 to Berg, et al. ("the '151 patent"). The '151 patent describes a method for producing a fabric having repeating patterns on both sides of the fabric. The method comprises folding or pleating a fabric, clamping the folded or pleated fabric so as to prevent dye access to portions of the fabric, dyeing the folded or pleated fabric, fixing the dye and unclamping the fabric. The dye migration is controlled by varying the temperature. As with traditional tie-dying methods, the '151 method is complex, time-consuming, and costly.

Other methods for dying fabrics to achieve a nonuniform result are described below. Although these patents describe processes for obtaining certain colored patterns, none of these methods achieve the desired "tie-dyed" look.

U.S. Pat. No. 5,201,915, issued Apr. 13, 1993 to Ricci ("the '915 patent"), describes a process for fading dyed textile products in a non-uniform way. This process involves coating fabric with a product which is resistant to bleaching or a discoloring chemical, breaking up the coating in a random way, bleaching or discoloring the fabric, and then removing the coating completely from the fabric so as to obtain a fabric which has discontinuous, random shaded/faded regions.

U.S. Pat. No. 5,082,468, issued Jan. 21, 1992 to Hopkins ("the '468 patent"), describes a method for pigmenting fabric surfaces to achieve a predetermined nonuniformly colored or faded appearance. This method involves treating moist garments with a pigment-containing foam composition which includes water, a dispersed pigment, auxiliary agents and a foaming agent, tumbling the treated garments in a tumbling machine, extracting the foam, and curing the garments by washing and drying.

U.S. Pat. No. 5,019,131, issued May 28, 1991 to Nitsch, Jr. ("the '131 patent"), describes a process for redyeing partially bleached fabrics or garments to yield sharply-etched multicolored designs. The method comprises dyeing a fabric, gathering selected areas of the fabric, bleaching the gathered background to remove the first dye color, redyeing the bleached area with a second color while leaving a white gap between the two dye colors, fixing the dye, and rinsing and washing the fabric.

U.S. Pat. No. 4,881,941, issued Nov. 21, 1989 to Dixon ("the '941 patent"), describes a method of producing di-colored or multi-colored dyed fabrics containing randomly placed colors. The method comprises dispersing solvent dye in an oil medium, placing a gathered textile or fabric partially into contact with the oil dye, placing the textile or fabric into an aqueous medium having a dye dispersed therein such that the dye is absorbed into the fabric only where the fabric has not already absorbed the oil-based dye, and then washing the dyed fabric with cold water.

U.S. Pat. No. 4,297,099, issued Oct. 27, 1981 to Simon, et al. ("the '099 patent"), describes a process for producing colored synthetic resin sheets wherein the dye coating on the resin sheets extends into the surface of the sheets in a uniform manner. The migration of the dye into the sheets is inhibited or controlled by the use of cross-linking agents. The method comprises applying dye to a resin sheet at an increased temperature in order to accelerate dye migration wherein dye migration promoters, such as plasticizers, can be utilized. Once the dye has migrated into the resin sheet to a desirable depth, cross-linking agents contained in the resin sheet are activated so as to inhibit the dye from migrating deeper into the resin sheet.

SUMMARY OF THE INVENTION

The present invention provides a method for applying color to a fabric to create random dye patterns thereon. The method comprises the steps of applying at least one dye accelerant onto the fabric in a random and nonuniform manner so that the resulting fabric has random areas containing dye accelerant and random areas not containing dye accelerant; applying dye to the fabric at a temperature effective to permit rapid absorption of the dye into the dye accelerant containing areas, and less or no absorption of the dye into the areas not containing dye accelerant; and removing unabsorbed dye while inhibiting migration of absorbed dye within the fabric.

The present invention also provides a method for applying color to a fabric utilizing an automated dyeing apparatus so as to create random dye patterns on said fabric. The method comprises the steps of: (a) processing the fabric in the automated dyeing apparatus so that it assumes a gathered condition; (b) simultaneously or shortly thereafter applying at least one dye accelerant onto the gathered fabric in a random and nonuniform manner so that the resulting fabric has random areas containing dye accelerant and random areas not containing dye accelerant; (c) applying dye to the fabric at a temperature effective to permit rapid absorption of the dye into the dye accelerant containing areas and less or no absorption of the dye into the areas not containing dye accelerant; and (d) removing the unabsorbed dye while inhibiting migration of absorbed dye within the fabric.

The present invention further provides a fabric dyed in a vat having differing random patterns of dye intensity of at least one color on opposite sides of the fabric in the same area. The fabric of the present invention has the appearance of tie-dyed fabric but differs from traditional tie-dyed fabric in that it is inherently less symmetrical, and has different dye patterns on opposite sides of the cloth. The fabric can be used in the applications in which conventional tie-dyed fabrics would be used, and additional applications which may be apparent to one skilled in the art.

DETAILED DESCRIPTION OF THE INVENTION

Figure 1:
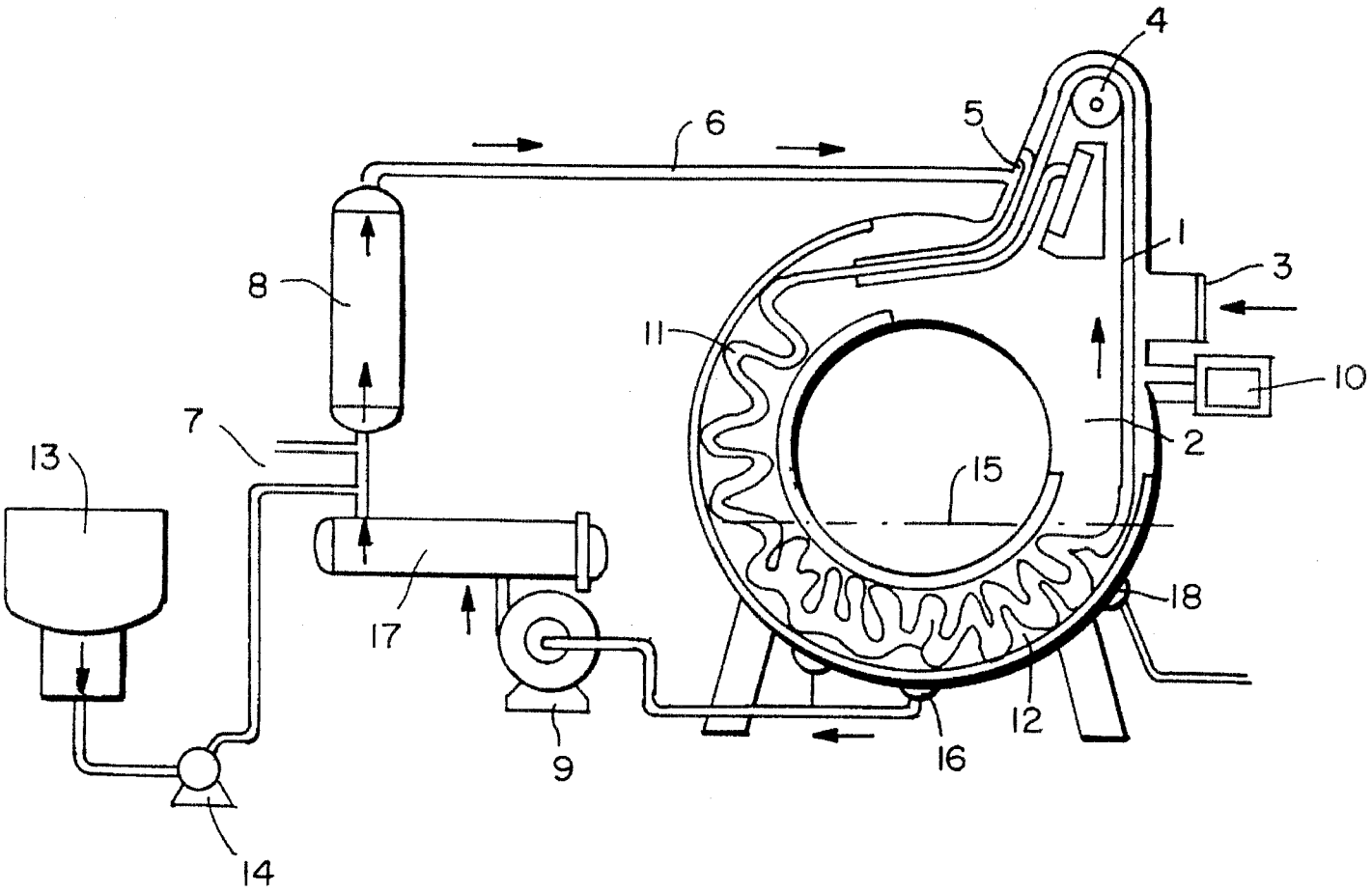
FIG. 1 represents the cross sectional view of the Thies Short Liquor Fabric Dyeing Machine with the fabric loaded onto the machine.

The goal of conventional solid color dyeing is to achieve a uniform and even uptake of dye by the fabric. To achieve this goal, various chemicals are applied to the fabric to control pH, fiber/metal lubricity, and other characteristics of the fabric to reduce and slow the uptake of dye. The dye is then applied at a controlled temperature to assure a uniform dye application.

The present invention is based upon the theory that, rather than applying chemicals which are designed to reduce and slow the uptake of dye on fabric, as in conventional dyeing, chemicals which enhance the uptake of dye are placed at arbitrary and random locations on the fabric, and the dyeing conditions are then controlled, contrary to standard practice, to achieve a rapid uptake of dye at various random positions, resulting in a fabric which resembles the "tie-dyed" look.

The tie-dyed fabric is produced by applying at least one dye accelerant onto the fabric in a random and nonuniform manner so that the resulting fabric has random areas containing dye accelerant and random areas not containing dye accelerant. The dye accelerant is applied to the fabric in a random and nonuniform manner by gathering or twisting the fabric and simultaneously or shortly thereafter applying the dye accelerant to the gathered or twisted fabric. In the preferred embodiment, the fabric is repeatedly twisted until a rope is formed. The dye accelerant is then applied to the twisted rope formation.

As used herein, "dye accelerant" is an agent or combination of agents which increase(s) the transfer or migration of dye from dye liquor to the fabric being dyed. Such agents may include chemicals which cause the fabric to swell and become more assessable to dye, as well as chemicals which increase the solubility of water to dye and therefore permit water molecules to hold more dye. Dye accelerants which possess these properties are commercially available and include but are not limited to Pomosperse AL-36 (containing poly(oxalkylene) alchol and quaternary ammonium compound) and POMOLEV DD-5 (containing diethylene glycol) (Piedmont Chemical Industries, Inc., High Point, N.C.). Similar products produced by other manufacturers also may be used. In the preferred embodiment, both POMOSPERSE AL-36 and POMOLEV DD-5 are used as dye accelerants.

To further enhance dye uptake in the accelerant treated areas, it is preferred that the dye accelerant is applied to the fabric at a pH in the range of 3–6, and most preferably in the range of 4–4.5. A pH in this range causes further swelling of the fibers in the areas treated with the dye accelerant. The pH may be adjusted by applying acetic acid or similar chemicals known in the art for adjusting pH. The pH may be measured using known pH meters. It also is preferred that the dye accelerant is applied to the fabric at a temperature in the range of 80°–120° F., and most preferably in the range of 95°–105° F. The uptake of dye also may be enhanced by subjecting the fabric to extensive washings prior to treatment with the dye accelerant.

Following application of the dye accelerant, the dye is applied to the fabric at a temperature effective to permit rapid absorption of the dye into the dye accelerant containing areas, and less or no absorption of the dye into the areas not containing dye accelerant. As used herein, the term "dye" includes any of the commercially available fabric dyes. The type of dye chosen will depend upon the type of fabric dyed. One or more colors of dye may be applied to the fabric at one time. The process also may be repeated using one or more different dye colors. The particular colors chosen as well as their time of application will depend upon the desired outcome. The temperature effective to permit rapid absorption of the dye is in the range of 160°–265° F. and most preferably is in the range of 180°200° F.

The temperature coupled with the non-uniform application of dye accelerants to the fabric, induces the dye to be picked up very rapidly in random areas of the fabric containing the dye accelerant, while less or no dye is picked up in areas not containing the dye accelerant. Since dye acceptance is based upon the positioning of accelerants and the positioning of dye and fabric, dye pickup on opposite sides of the same fabric section are considerably different.

In the last step of the method, the unabsorbed dye is removed while inhibiting migration of absorbed dye within the fabric. The unabsorbed dye is removed by rinsing the fabric with water as is done following conventional uniform dying of fabrics. As used herein, the phrase "inhibiting migration of absorbed dye within the fabric" means inhibiting the transfer of absorbed dye from areas containing high concentration of dye to areas containing less or no concentration of dye. The migration of the dye may be inhibited by setting the pH of the fabric in the range of 7.0–9.0, and preferably in the range of 8.0–8.5. The pH is set as described above. The fabric may then be washed and rinsed by conventional means. The fabric also may be treated with various commercially available softeners as in conventional uniform dyeing.

It is also within the confines of the present invention that the method may be automated using commercially available dye processing equipment. In the preferred embodiment, the equipment is the Thies Short Liquor Fabric Dyeing Machine (Thies Corp., Rock Hill, S.C.). The Thies Machine is preferred because it is permits the operator to manipulate the gathering or twisting of the fabric by controlling pump pressure and reel speed, the temperature of the fabric, as well as the application of auxiliary chemicals such as dye accelerants, dyes, and softeners. Other dye processing equipment which permits the operator to control these functions may be used.

To automate the method of the present invention using the Thies Machine, the fabric (1) is loaded into the chamber (2) of the machine through port (3) using the lifter reel (4) as shown in FIG. 1. The fabric is then twisted at position (5) by the application of water pressure from tube (6). The water enters the machine through tube (7), and the temperature and pressure of the water entering position (5) are controlled by heat exchanger (8) and pump (9), respectively. The pump pressure, reel speed, and temperature are controlled by computer (10). It is preferred although not necessary that the fabric is loaded into the chamber (2) beyond the normal and expected capacity of 300 kg of fabric per chamber, and most preferably at the maximum capacity of 600 kg of fabric per chamber. The maximum capacity may be achieved by setting the pump pressure at 0.6–0.9 bar, and preferably at 0.9 bar, and the reel speed at about 100 yards of fabric per minute. The twisted fabric (11) cascades down into the dyeing vat (12), and eventually returns to port (3) as the fabric is loaded into the chamber. Once the fabric returns to port (3), the initial end of the fabric put into the chamber is sewn onto the trailing end. The resulting sewn fabric resembles a loop as shown in FIG. 1.

The fabric may then be subjected to conventional washing and rinsing cycles. The soap for the washing cycle is added in add tank (13), and is pumped by pump (14) through the heat exchanger (8), and into the chamber (2) at position (5), where it cascades down into the dyeing vat (12) and mixes with water (15). Once the soap is emptied from the add tank (13), it may be recycled by passing through drain (16), pump (9), filter (17), heat exhanger (8), and into the chamber (2) at position (5). The water for the rinsing cycle enters tube (7), is heated by heat exchanger (8), and enters the chamber (2) at position (5). The waste from the washing and rinsing cycles is removed via the rinse drain (18). Although it is not necessary, the fabric's receptiveness to dye application may be maximized by extending the washing time, or adding additional washing cycles.

The dye accelerants are then added to accelerate the uptake of dye. As shown in FIG. 1, the dye accelerant is placed into the add tank (13), and is pumped by pump (14) through heat exhanger (8), and enters the chamber (2) at position (5) where it is applied to the twisted fabric. The dye accelerant may be applied to the fabric at a pH in the range of 3–6, and most preferably in the range of 4–4.5. The pH is adjusted by adding 0.5 g of acetic acid per liter of water to the add tank (13). The dye accelerant is added at a temperature in the range of 80°–120° F. and most preferably in the range of 95°–105° F. The temperature is controlled using heat exchanger (8), which is controlled by computer (10). The dye accelerant is applied until all of the accelerant is removed from the add tank (13).

Figure 2:
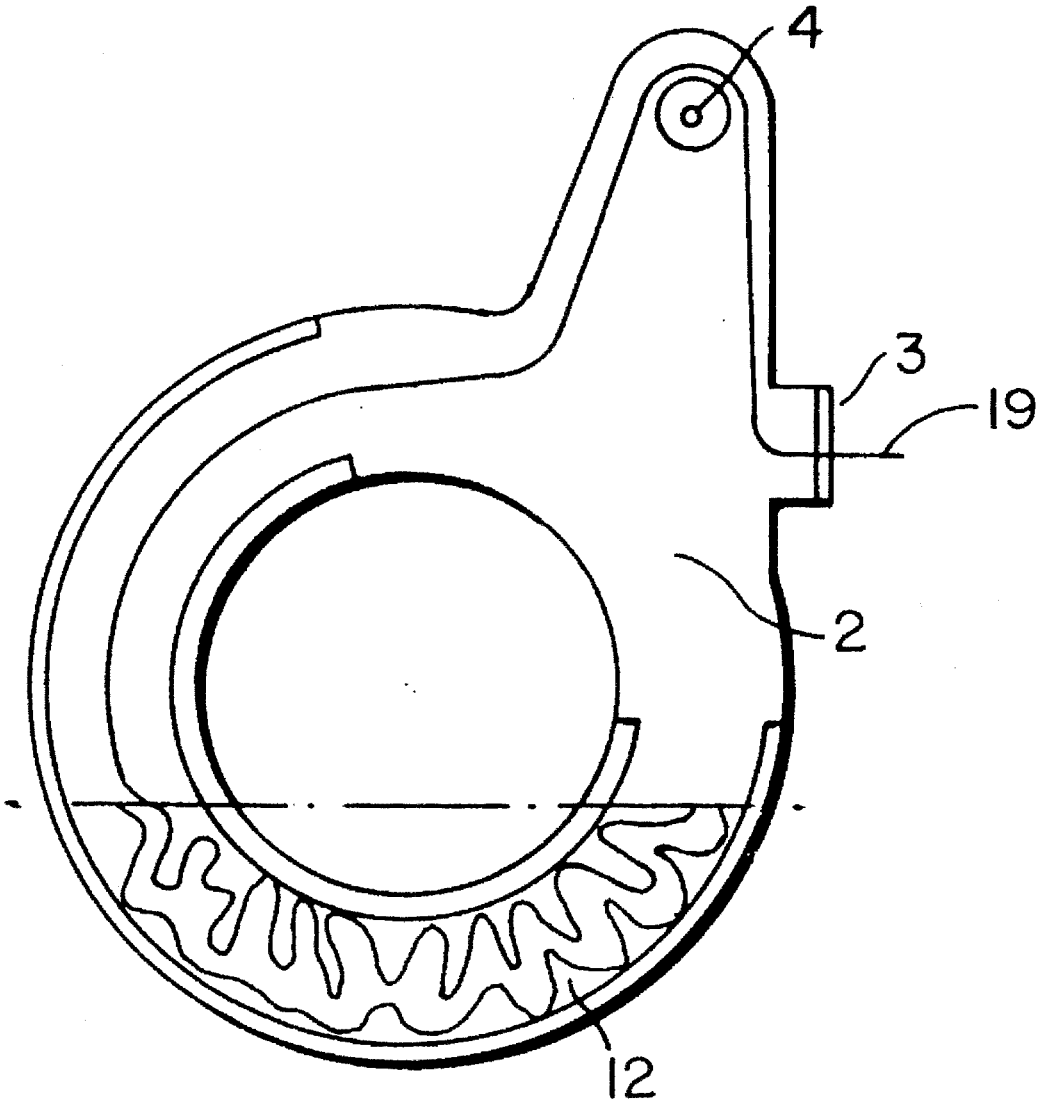
FIG. 2 represents the cross sectional view of a portion of the Thies Short Liquor Fabric Dyeing Machine showing the fabric lying at the bottom of the vat.

Following application of the dye accelerant, the fabric is cut, and proceeds to fall into the dyeing vat (12). A string or other suitable material (19) (FIG. 2) is tied to the end of fabric to permit recovery of the fabric. Once the fabric is in the dyeing vat as shown in FIG. 2, the lifter reel (4) is turned off. The temperature of the fabric is then raised to about 160°–265° F., and preferably 180°–200° F., using water heated by the heat exhanger (8). The dye is then added to add tank (13) and pumped into the chamber (2) at position (5) using pump (14). It is preferred although not necessary that the liquor ratio (i.e., the weight ratio of fabric to dye) is set lower than conventional uniform dyeing, and preferably is set at approximately 4 to 1 so that reduced dye quantities per weight of fabric are applied. Once the dye is emptied from the add tank (13), it is recycled by passing through drain (16), pump (9), filter (17), heat exhanger (8), and into the chamber (2) at position (5) until it enters the dyeing vat (12). The dyeing is performed for a sufficient period to permit dye migration from the liquor to the fabric. The preferred dyeing time is about 30 minutes. The dyeing time is controlled using computer (10).

Once the dyeing is completed, a portion of the fabric is pulled out of port (3) using the string (19) (FIG. 2), and sewn back into a loop for rinsing. The rinsing is conducted at a relatively high pH in the range of 7–9 and preferably at a pH in the range of 8.0–8.5 to prevent dye migration within the fabric. The pH is adjusted as described above. The rinse is emptied from the vat through the rinse drain (18). The fabric is then washed, rinsed and removed from the machine from port (3) in a conventional manner.

Figure 3:
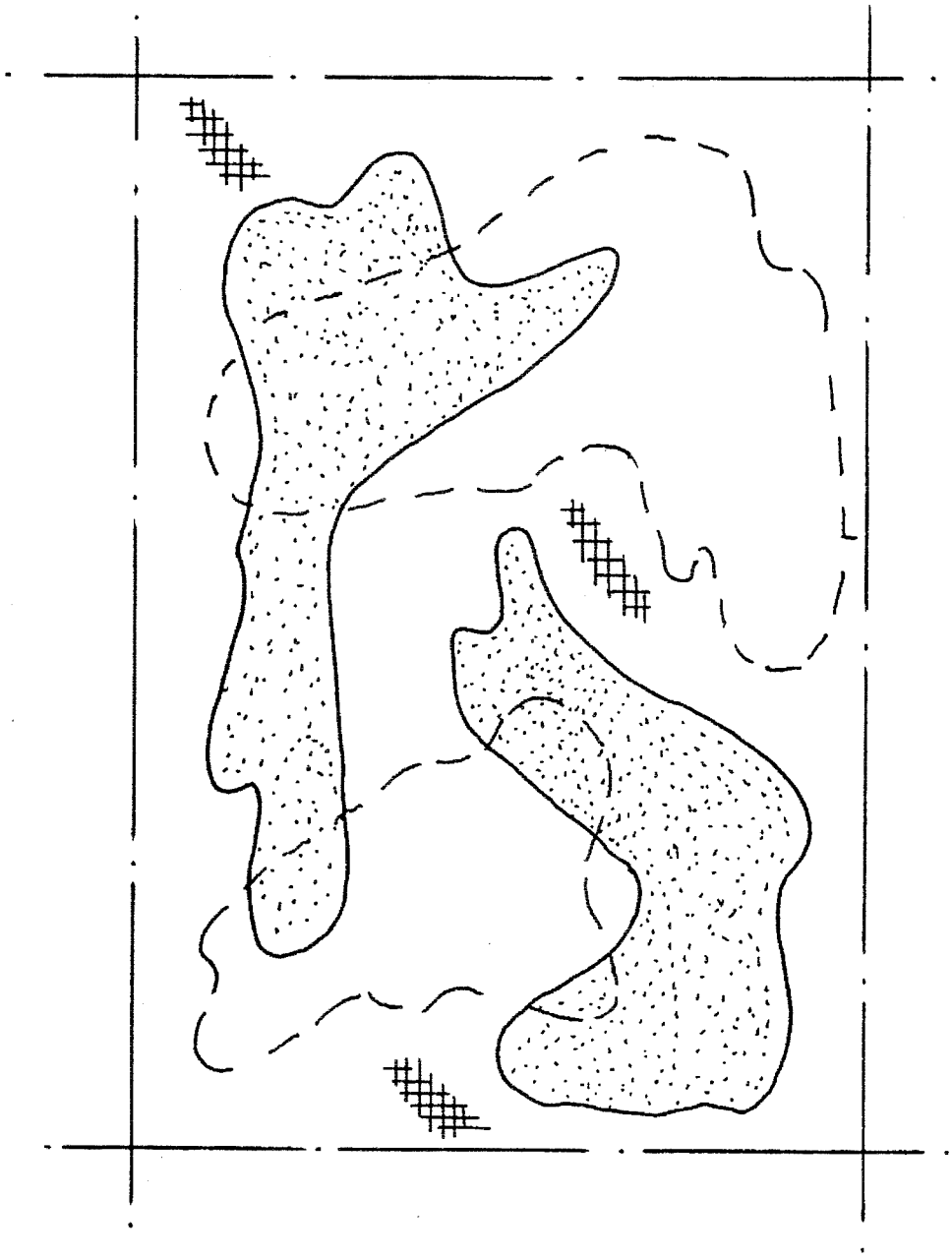
FIG. 3 represents a simulated view of the dyed pattern on opposite sides of a fabric.

The resulting fabric has differing random patterns of dye intensity of at least one color on opposite sides of the fabric in the same area as shown in FIG. 3. The solid lines represent the facing view of the fabric while the dotted lines represent the view on the opposite side of the fabric.

The present invention is described in the following Example which is set forth to aid in an understanding of the invention, and should not be construed to limit in any way the invention as defined in the claims which follow thereafter.

EXAMPLE

White fabric was loaded into the Thies Machine to a maximum capacity of 600 kg at a rate of 100 yards per minute and at a pump pressure of 0.9 bar. Once the fabric was loaded onto the machine, the ends of the fabric were sewn together, and the fabric was subjected to three wash, hold and rinse cycles. POMOLEV DD-5 and POMOSPERSE AL-36 were then added, and the pH was adjusted to 4.5 by adding 0.5 g acetic acid per liter of water The fabric was then heated to 180° F. the seams of the fabric were cut so that the fabric would fall into the dyeing vat, and the lifter wheels were turned off. Dye was then applied at a liquor ratio of 4 to 1, and held for 30 minutes. The fabric was then sewn back into a loop, the pH was set at approximately 8.5, and the fabric was rinsed. Following the rinse, the fabric was washed and rinsed by conventional means, and removed from the machine.

What is claimed is:

1. A method for applying color to a fabric to create random dye patterns thereon comprising the steps of gathering the fabric and simultaneously or shortly thereafter applying at least one dye accelerant onto the gathered fabric in a random and nonuniform manner so that the resulting fabric has random areas containing dye accelerant and random areas not containing dye accelerant; applying dye to the fabric at a temperature effective to permit rapid absorption of the dye into the dye accelerant containing areas, and less or no absorption of the dye into the areas not containing dye accelerant; and removing unabsorbed dye while inhibiting migration of absorbed dye within the fabric.

2. The method of claim 1, wherein the dye accelerant comprises poly(oxyalkylene) alcohol, a quaternary ammonium compound and diethylene glycol.

3. The method of claim 1, wherein the dye accelerant is applied to the fabric at a pH in the range of 3–6.

4. The method of claim 3, wherein the pH is in the range of 4–4.5.

5. The method of claim 1, wherein the dye accelerant is applied to the fabric at a temperature in the range of 80°–120° F.

6. The method of claim 5, wherein the temperature is in the range of 95°–105° F.

7. The method of claim 1, wherein the dye is applied to the fabric at a temperature in the range of 160°–65° F.

8. The method of claim 7, wherein the temperature is in the range of 180°–200° F.

9. The method of claim 1, wherein the unabsorbed dye is removed by rinsing the fabric.

10. The method of claim 1, wherein dye migration is inhibited by maintaining the fabric at a pH of 7–9.

11. The method of claim 10, wherein the pH is 8.0–8.5.

12. A method for applying color to a fabric utilizing an automated dyeing apparatus so as to create random dye patterns on the fabric comprising the steps of:

(a) processing the fabric in the automated dyeing apparatus so that it assumes a gathered condition;

(b) simultaneously or shortly thereafter applying at least one dye accelerant onto the gathered fabric in a random and nonuniform manner so that the resulting fabric has random areas containing dye accelerant and random areas not containing dye accelerant;

(c) applying dye to the fabric at a temperature effective to permit rapid absorption of the dye into the dye accelerant containing areas and less or no absorption of the dye into the areas not containing dye accelerant; and (d) removing the unabsorbed dye while inhibiting migration of absorbed dye within the fabric.

13. The method of claim 12 which further comprises the step of washing the fabric at least once prior to applying dye accelerant thereto.

14. The method of claim 12, wherein the dye accelerant comprises poly(oxyalkylene) alcohol a quaternary ammonium compound and diethylene glycol.

15. The method of claim 12, wherein the dye accelerant is applied to the fabric at a pH in the range of 3–6.

16. The method of claim 15, wherein the pH is in the range of 4–4.5.

17. The method of claim 12, wherein the dye accelerant is applied to the fabric at a temperature in the range of 80°–120° F.

18. The method of claim 17, wherein the temperature is in the range of 95°–105° F.

19. The method of claim 12, wherein the dye is applied to the fabric at a temperature in the range of 160°–265° F.

20. The method of claim 19, wherein the temperature is in the range of 180°–200° F.

21. The method of claim 12, wherein the unabsorbed dye is removed by rinsing the fabric.

22. The method of claim 12, wherein dye migration is inhibited by maintaining the fabric at a pH of 7–9.

23. The method of claim 22, wherein the pH is 8.0–8.5.

* * * * *